US006758013B2

(12) United States Patent
Staser et al.

(10) Patent No.: US 6,758,013 B2
(45) Date of Patent: Jul. 6, 2004

(54) INTEGRATED ROLLER CABLE ASSEMBLY

(75) Inventors: Brian H. Staser, Rochester Hills, MI (US); Mike J. Skiba, Sterling Heights, MI (US)

(73) Assignee: Delphi Technologies, Inc., Troy, MI (US)

( * ) Notice: Subject to any disclaimer, the term of this patent is extended or adjusted under 35 U.S.C. 154(b) by 107 days.

(21) Appl. No.: 10/056,618

(22) Filed: Jan. 25, 2002

(65) Prior Publication Data

US 2003/0140562 A1 Jul. 31, 2003

(51) Int. Cl.[7] ..... E05F 11/48; E05F 11/38
(52) U.S. Cl. ..... 49/352; 49/374; 16/90
(58) Field of Search ..... 49/352, 348, 349, 49/502, 360, 374; 16/96 R, 90, 94 R, 91, 93 R; 296/146.5, 146.2

(56) References Cited

U.S. PATENT DOCUMENTS 4,829,711 A * 5/1989 Sambor ..... 49/211
5,309,678 A 5/1994 Adachi
5,333,411 A 8/1994 Tschirschwitz et al.
5,657,580 A * 8/1997 Kobrehel ..... 49/352
6,088,965 A * 7/2000 Fukumoto et al. ..... 49/352
6,115,966 A * 9/2000 Shibata ..... 49/352
6,161,894 A 12/2000 Chapman
6,338,509 B1 1/2002 Rice et al.
6,358,073 B1 3/2002 Jhanson et al.
6,390,535 B1 5/2002 Chapman
6,464,287 B2 10/2002 Rogers, Jr. et al.
6,481,783 B1 11/2002 Rogers, Jr. et al.
6,517,365 B1 2/2003 Bungo et al.
6,539,670 B2 4/2003 Haag et al.
6,560,569 B1 5/2003 Risdon et al.

* cited by examiner

*Primary Examiner*—Hugh B. Thompson, II
(74) *Attorney, Agent, or Firm*—Scott A. McBain

(57) ABSTRACT

An automotive vehicle door has a glass window that is raised and lowered by a window regulator that includes a roller cable assembly (15). The roller cable assembly (15) has a rolled section guide rail (18) and a bracket assembly (16) at the lower end portion of the glass window that runs on an L-shaped flange (36) of the guide rail (18). The roller cable assembly (15) includes upper and lower roller assemblies (28 and 30) at the respective upper and lower ends of guide rail (18) and a cable (20) that is trained on rollers (22 and 24) of the roller assemblies and on a drive roller (26) that is driven by an electric motor (32). Each roller assembly includes a base (42) that is slideably attached to the guide rail (16) and a detachable cap pin (44) that attaches the guide roller to the base (42).

14 Claims, 6 Drawing Sheets

PRIOR ART

INTEGRATED ROLLER CABLE ASSEMBLY

FIELD OF INVENTION

This invention relates to a roller cable assembly and more particularly to a roller cable assembly of the type that is used in a window regulator.

BACKGROUND OF THE INVENTION

U.S. Pat. No. 5,309,678 granted to Tadashi Adachi May 10, 1994 discloses a schematic general construction of a power window device for a vehicle door in FIG. 4 of the patent. A window glass of the door is slideably supported at its front and back ends by door frames which are arranged along the vertical direction of the door. A bracket that is secured to the lower end portion of the window glass slides on a vertical guide rail that is fixed to the vehicle door. The bracket is secured to a tape that is trained over three rollers so as to run in a triangular loop. The three rollers include two guide rollers at the upper and lower ends of the guide rail and a third drive roller that is between the two guide rollers in the vertical direction and spaced form the guide rollers in the horizontal direction. The drive roller which is driven by a electric motor, drives the tape which in turn raises and lowers the window glass. In an alternate arrangement shown in FIG. 3 of the patent, the lower guide roller is driven eliminating the need for a third roller. The structure of the guide rail and the manner of attaching the guide rollers at the upper and lower ends of the guide rail is not disclosed in detail.

U.S. Pat. No. 5,333,411 granted to Herbert Tschirschwitz et al Aug. 2, 1994 discloses a cable window winder comprising a vertical guide rail and a slide element or bracket that is secured to the lower end portion of a window glass. A holding angle is fixed at each end of the guide rail. A pulley rotates on a double stepped axle bolt that is permanently attached to each holding angle. Each holding angle is attached to a panel by a screw that passes through the associated axle bolt. The ends of a cable are fixed to the slide element. The cable wraps around the pulleys and then winds around a cable drum that is spaced from the pulleys in a triangular arrangement. The cable drum is rotatably fixed to the panel. The cable drum is rotated to raise and lower the window glass. The portions of the cable that are between the cable drum and the respective holding angles slide in sheaths or Bowden sleeves that are connected to the cable drum housing at one end and to the respective holding angle at the other end.

SUMMARY OF THE INVENTION

In its broadest sense, the invention provides an integrated roller cable assembly comprising a guide rail with at least one roller assembly at one end that is easy to assembly and economical to manufacture.

The roller assembly comprises a base that slides into a slot in a rolled section guide rail and a roller that is rotatably attached to the base by a detachable cap pin. The detachable cap pin is attached to the base easily and without need for any other fasteners. The base preferably has a fitting for attaching an end of a conduit for the cable to the base. The detachable cap pin preferably includes a head with an L-shaped arm that keeps the cable in a peripheral groove of the pulley and that can be used to keep an end fitting of the cable away from the fitting for the end of the conduit.

DETAILED DESCRIPTION OF PREFERRED EMBODIMENT

Figure 1:
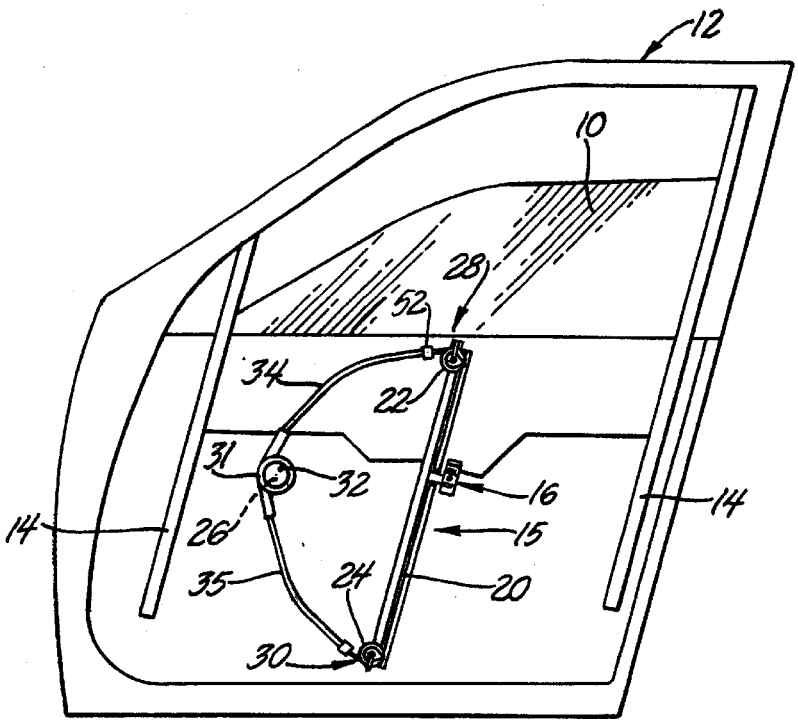
FIG. 1 is a front view of a door, schematic in nature, showing a power window regulator having a roller cable assembly of the invention.

Referring now to FIG. 1, a window glass 10 of an automotive door 12 is slideably supported at its front and back ends by guides 14. Window glass 10 is raised and lowered by a window regulator 15 that includes a bracket assembly 6 that is secured to the lower end of the window glass 10. Bracket assembly 16 runs on a vertical guide rail 18 that is supported by the automotive door. Bracket assembly 16 is moved vertically on guide rail 18 by a cable 20. The ends of cable 20 are attached to bracket assembly 16 with the cable trained over three rollers 22, 24 and 26 so as to run in a triangular loop. Rollers 22 and 24 are guide rollers that are part of an upper roller assembly 28 at the top of guide rail 18 and a lower roller assembly 30 at the bottom of guide rail 18 respectively. The third roller 26 is a drive roller that is supported on door 12 in a housing 31and driven by an electric motor 32. Cable 20 runs in a first conduit 34 between upper roller assembly 28 and housing 31 and in a second conduit 35 between lower roller assembly 30 and housing 31.

Figure 2A:
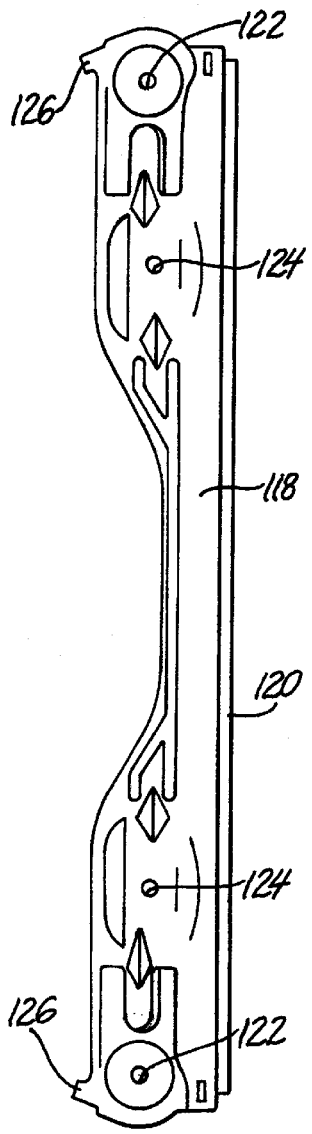
Fig.2A PRIOR ART
FIG. 2*a* is a front view of a prior art guide rail that is stamped.
Figure 2B:
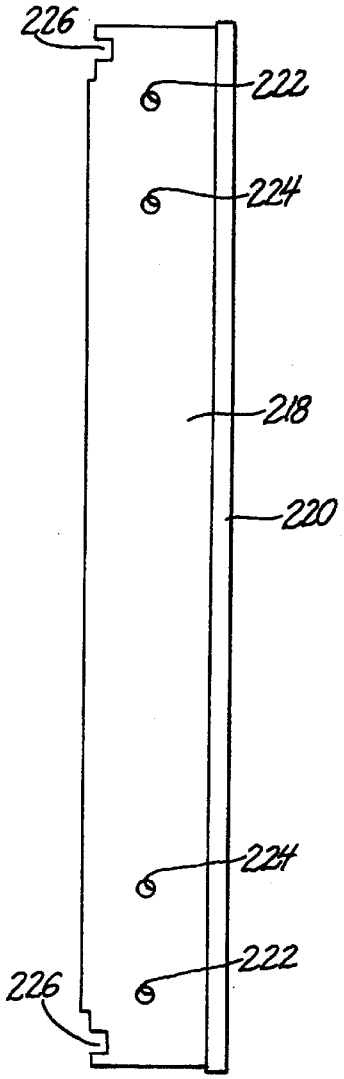
FIG. 2*b* is a front view of a prior art guide rail that is a rolled section.

FIGS. 2*a* and 2*b* illustrate prior art guide rails. FIG. 2*a* shows a prior art guide rail 118 that is a stamped part. Guide rail 118 has a guide flange 120 at one edge that is L-shaped in cross section and used to attach a bracket assembly or the like at the lower end portion of a window glass to the guide rail for sliding movement with respect to the guide rail. Guide rail 118 also includes holes 122 for attaching rollers at the upper and lower ends of the guide rail, two holes 124 in embossments for attaching the guide rail to a vehicle door, and two protrusions 126 for attaching the ends of cable conduits near the respective rollers that would be attached to guide rail 118 at holes 122. The stamped guide rail is satisfactory from a functional standpoint. However, the stamped part is heavy, produces substantial scrap and is relatively expensive to manufacture.

FIG. 2*b* shows a prior art guide rail 218 that is a rolled section. Guide rail 218 also has an L-shaped guide flange 220 at one edge for slideably attaching a bracket assembly or the like at the lower portion of a window glass, holes 222 for attaching rollers at the upper and lower ends of the guide rail, holes 224 for attaching top. And slots 226 for attaching the ends of cable conduits near the respective rollers that would be attached to guide rail 218 at holes 222. This guide rail is also satisfactory from a functional standpoint.

Moreover, guide rail 218 is easier and less expensive to manufacture in comparison to stamped guide rail 118. However, guide rail 218 is relatively wide due to the necessity of providing slots 226 for attaching the ends of cable conduits.

Figure 7:
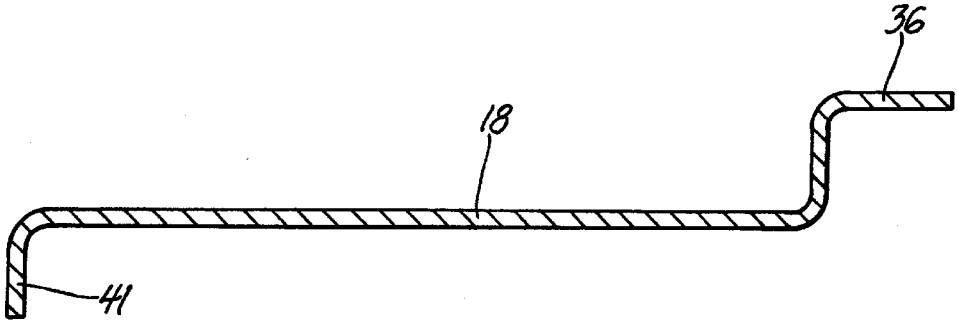
FIG. 7 is a section taken substantially along the line 7—7 of FIG. 3 looking in the direction of the arrows.
Figure 3:
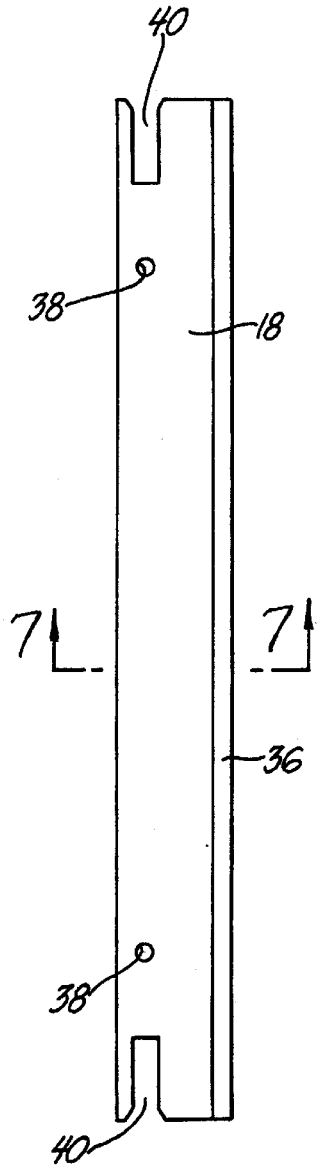
FIG. 3 is a front view of a guide rail that is part of the roller cable assembly of the invention that is shown in FIG. 1.

FIG. 3 shows the guide rail 18 forming part of the invention. Guide rail 18 is a rolled section that has a flange 36, L-shaped in cross section, along one edge for attaching bracket assembly 16 to the guide rail and two holes 38 for attaching the guide rail to a vehicle door. However, guide rail 18 is unique in that guide rail 18 is relatively narrow with just open ended, vertical slots 40 in each end for attaching the respective upper and lower roller assemblies 28 and 30. Guide rail 18 may also include a flange 41 at the opposite edge for increased strength as shown in FIG. 7.

In its broadest sense this invention provides a roller cable assembly comprising a rolled section guide rail 18 having an L-shaped flange 36 or the like for attaching a bracket assembly (runner), and at least one roller assembly such as roller assembly 28 or 30. The invention preferably includes a roller assembly at each end, a cable that is protected in a sheath that is attached to the roller assembly at each end of the guide rail, and a bracket that runs on the guide rail and that is attached to the cable between the upper and lower roller assemblies.

Figure 4:
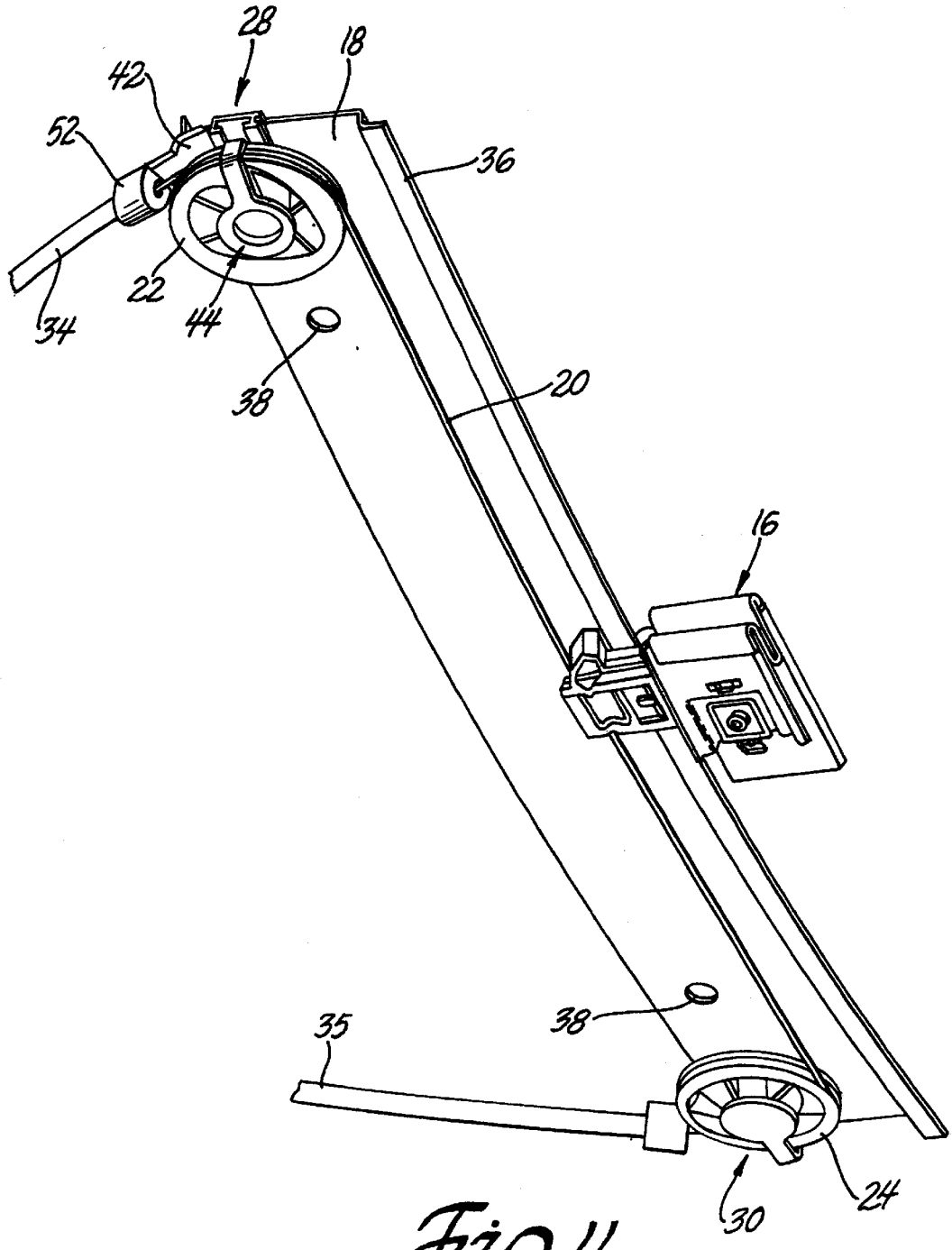
FIG. 4 is a perspective view of a roller cable assembly of the invention.
Figure 5:
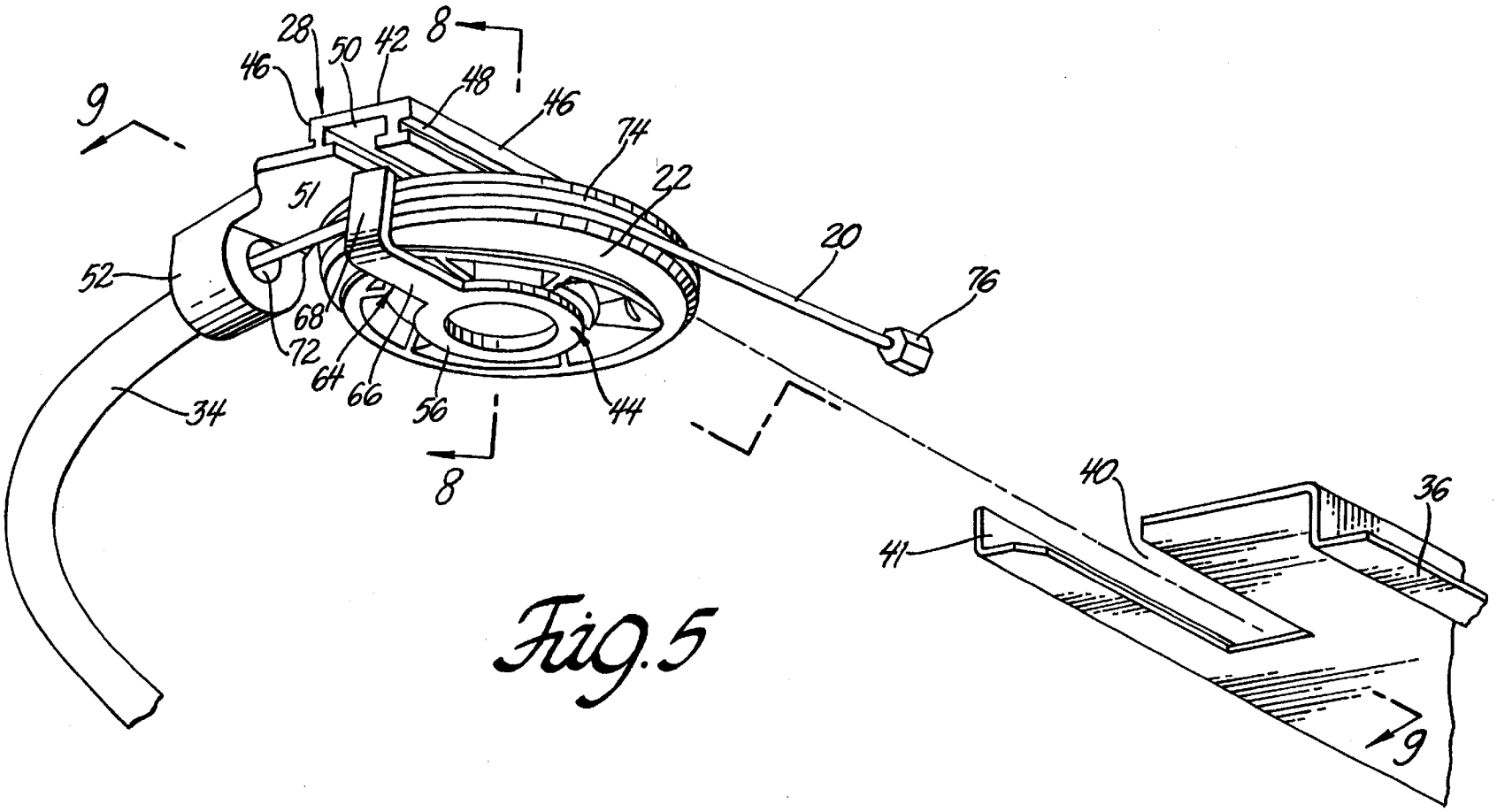
FIG. 5 is a perspective view of a cable sub-assembly of the roller cable assembly shown in FIG. 4.
Figure 6:
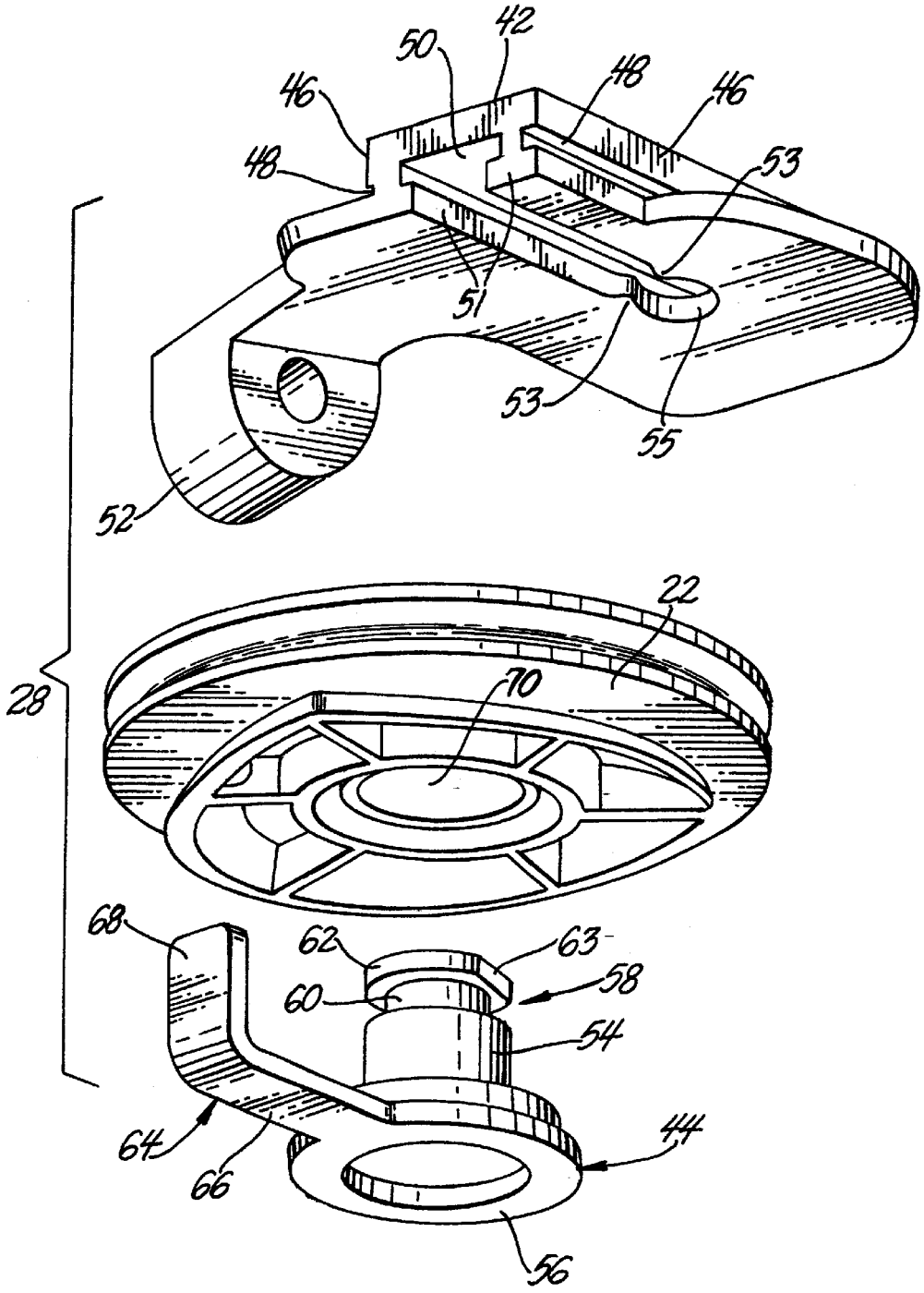
FIG. 6 is an exploded perspective view of the cable subassembly shown in view 5.
Figure 8:
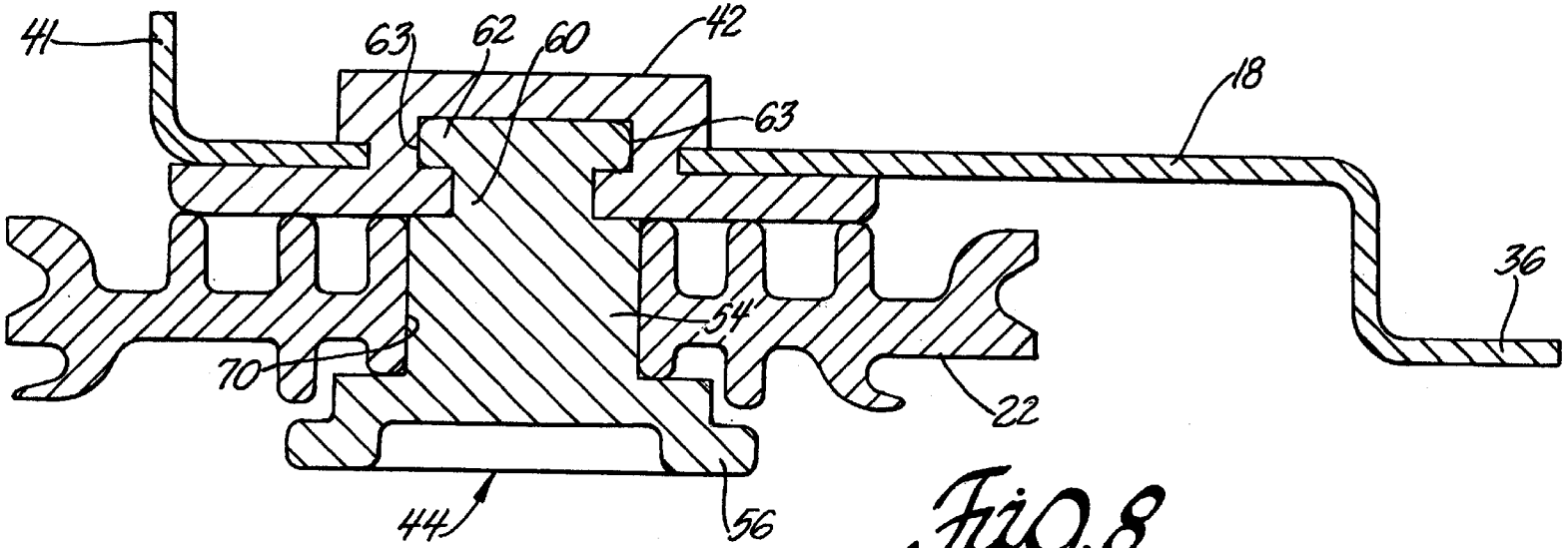
FIG. 8 is a section taken substantially along the line 8—8 of FIG. 5 looking in the direction of the arrows.
Figure 9:
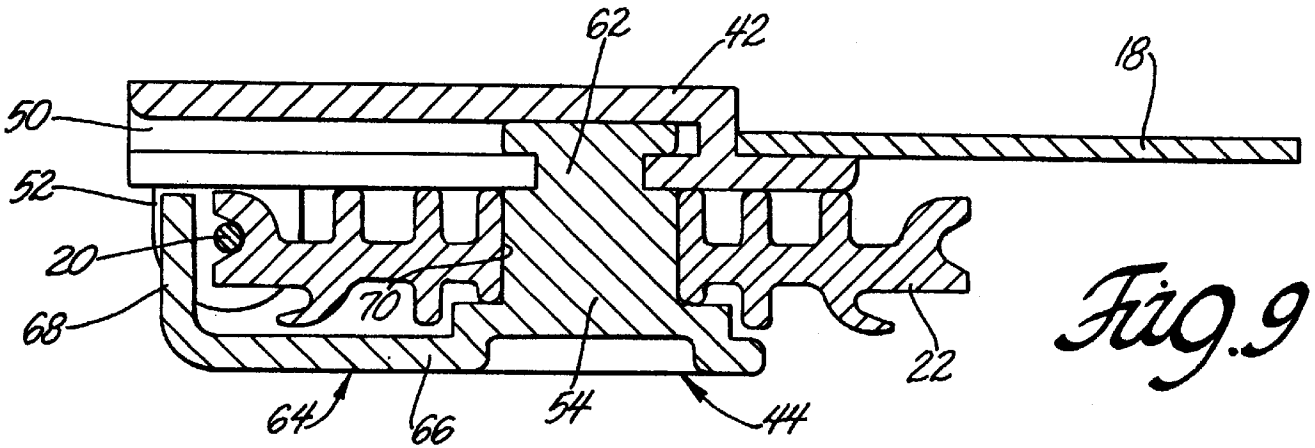
FIG. 9 is a section taken substantially along the line 9—9 of FIG. 5 looking in the direction of the arrows.

Referring now to FIGS. 4, 5 and 6, the typical upper roller assembly 28 comprises roller 22, base 42 and cap pin 44. Base 42 has side walls 46, each of which has a longitudinal groove 48 for attaching base 42 to guide rail 18. Base 42 is slid onto the end of guide rail 18 by inserting the longitudinal edge portions of guide rail 18 adjacent slot 40 into grooves 48. Base 42 is retained on the end of guide rail 18 by friction and tension on cable 20. Base 42 has a longitudinal groove 50, which is formed to provide side rails 51, and a conduit end fitting 52 that are used to attach cap pin 44 and a sheath or conduit to base 22 as explained below.

Cap pin 44 comprises a round pin 54 having a head 56 at one end and an attachment 58 at the other end comprising a neck 60 and a segment 62 of the round pin outboard of the neck 60 that has two parallel flats 63. Head 56 includes an L-shaped arm 64 that as a radial portion 66 and an axial portion 68 that are parallel to flats 63. Cap pin 44 attaches roller 22 to base 42 by inserting pin 54 through hole 70 of roller 22 and then sliding the attachment 58 of cap pin 44 into groove 50. Cap pin 44 is retained in groove 50 in the transverse direction by rails 51. Cap pin 44 is retained in the longitudinal direction by nibs 53 at the end of a socket 55 that retains neck 60.

Cable 20 slides in a protective sheath or conduit 34 between roller assembly 28 and drive roller 26 (and in another conduit 35 between roller assembly 30 and drive roller 26). The end of conduit 34 is attached to base 42 by means of fitting 52 that has a hole 72 for cable 20 to extend through. Cable 20 exits hole 72 and then wraps around roller 22 which preferably has a peripheral groove 74 for locating cable 20 laterally. The end of cable 20 has a end fitting 76 for attaching cable 20 to bracket assembly 16. Arm 64 keeps cable 20 in groove 76 and stops end fitting 78 from going past arm 64 toward conduit fitting 52.

Lower roller assembly 30 is substantially identical to upper roller assembly 28 except the base 42 of the lower roller assembly is the mirror image of the upper base 42. However, the cap pin is identical to cap pin 44 and roller 24 is identical to roller 22.

As indicated above, this invention concerns a roller cable assembly comprising a rolled section guide rail 18 having an L-shaped flange 36 or the like for attaching a bracket assembly (runner), and at least one roller assembly such as roller assembly 28 or 30. The invention preferably also includes a roller assembly at each end, a cable that is protected in a sheath that is attached to the roller assembly at each end of the guide rail, and a bracket assembly or the like that runs on the guide rail and that is attached to the cable between the upper and lower roller assemblies.

The present invention has been described in accordance with the relevant legal standards, thus the foregoing description is exemplary rather than limiting in nature. Variations and modifications to the disclosed embodiments may become apparent to those skilled in the art. Accordingly, the scope of legal protection afforded this invention can be determined by studying the following claims.

We claim:

1. A roller cable assembly comprising:

a rolled section guide rail (18) having a shaped flange (36) for attaching a bracket (16) to the guide rail so that the bracket (16) moves with respect to the guide rail and a longitudinal slot (40) at one end of the guide rail, and a roller assembly (28) attached to the one end of the guide rail, the roller assembly having a roller (22), a base (42) and a detachable cap pin (44), the base (42) having side walls (46), each of which has an exterior longitudinal groove (48) that receives a longitudinal edge portion of the guide rail (18) adjacent the longitudinal slot (40) so as to attach the base (42) to the guide rail (18), and the roller (22) being rotatably attached to the base (42) by the detachable cap pin (44).

2. The roller cable assembly as defined in claim 1 wherein the base (42) has a fitting (52) for attaching an end of a conduit to the base.

3. The roller cable assembly as defined in claim 1 wherein the base (42) has a longitudinal groove (50), which is formed to provide side rails (51), and the cap pin (44) has a round pin (54) that has a head (56) at one end and an attachment (58) at the other end, the cap pin (44) being attached to the base (42) by the attachment (58) cooperating with the groove (50).

4. The roller cable assembly as defined in claim 1 wherein the longitudinal slot (40) at the one end of the guide rail (18) provides two spaced, coplanar longitudinal edge portions and the base (42) has side walls (46), each of which has a longitudinal groove (48) that receives one of the two spaced, coplanar longitudinal edge portions of the guide rail (18) provided by the longitudinal slot (40) so as to attach the base (42) to the guide rail (18).

5. A roller cable assembly comprising:

a rolled section guide rail (18) having a shaped flange (36) for attaching a bracket (16) to the guide rail so that the bracket (16) moves with respect to the guide rail, and a roller assembly (28) attached to each end of the guide rail, the roller assembly having a roller (22), a base (42) and a detachable cap pin (44), the base (42) having side walls (46), each of which has a longitudinal groove (48) that receives a longitudinal edge portion of the guide rail (18) so as to attach the base (42) to the guide rail (18) and a fitting (52) for attaching an end of a conduit to the base, the roller (22) being rotatably attached to the base (42) by the detachable cap pin (44), the base (42) having another longitudinal groove (50), which is formed to provide side rails (51), and the cap pin (44) having a round pin (54) that has a head (56) at one end and an attachment (58) at the other end, the cap pin (44) being attached to the base (42) by the attachment (58) cooperating with the another groove (50).

6. The roller cable assembly as defined in claim 5 wherein the attachment (58) includes a neck (60) and a segment (62) of the round pin outboard of the neck (60) and wherein the cap pin (44) attaches the roller (22) to the base (42) by inserting pin (54) through a hole (70) of the roller (22) and then sliding the attachment (58) of the cap pin (44) into the another groove (50); the cap pin (44) being retained in the another groove (50) in the longitudinal direction by the side rails (51) in the another groove (50) and in the transverse direction by a socket (55) that receives the neck (60).

7. The roller cable assembly as defined in claim 6 wherein the head (56) includes an L-shaped arm (64) that as a radial portion (66) and an axial portion (68), the axial portion (68) being spaced outwardly of the roller (22).

8. The roller cable assembly as defined in claim 7 including a cable (20) that wraps around the roller (22) and wherein the roller (22) has a peripheral groove (74) for locating the cable (20) laterally, and the axial portion (68) of the L-shaped arm (64) keeps the cable (20) in the peripheral groove (74).

9. The roller cable assembly as defined in claim 8 including a sheath (34) for the cable (20) that is attached to the base (42) by the conduit end fitting (52).

10. The roller cable assembly as defined in claim 9 including a bracket (16) that is moveably attached to the guide rail (18) and wherein the end of cable (20) has an end fitting (76) attaching the cable (20) to the bracket (16).

11. The roller cable assembly as defined in claim 10 wherein the L-shaped arm (64) stops the end fitting (76) from going past the arm (64) toward the conduit fitting (52).

12. A roller cable assembly comprising:

a rolled section guide rail (18) having a shaped flange (36) for attaching a bracket (16) to the guide rail so that the bracket (16) moves with respect to the guide rail, a cable (20) having a fitting (76) at each end attaching the cable to the bracket, and a roller assembly (28, 30) attached to each end of the guide rail, each roller assembly having a roller (22, 24), a base (42) and a cap pin (44), each base (42) having side walls (46), each of which has a longitudinal groove (48) that receives a longitudinal edge portion of the guide rail (18) so as to attach each base (42) to the guide rail (18) and a fitting (52) for attaching an end of a conduit (34, 35), that surrounds a portion of the cable (20) to each base (42), each roller (22, 24) being rotatably attached to the respective base (42) by the respective cap pin (44), each base (42) having another longitudinal groove (50), which is formed to provide side rails (51), and each cap pin (44) having a round pin (54) that has a head (56) at one end and an attachment (58) at the other end, each cap pin (44) being attached to the respective base (42) by the attachment (58) cooperating with the respective another groove (50).

13. The roller cable assembly of claim 12 wherein the cable (20) wraps around the roller (22, 24) of each roller assembly (28,30) and wherein each roller (22, 24) has a peripheral groove (74) for locating the cable (20) laterally.

14. The roller cable assembly as defined in claim 13 wherein the head (56) of each cap pin (44) has an L-shaped arm (64) and wherein each end of the cable (20) has an end fitting (76) attaching the cable (20) to the bracket (16) that cannot pass the L-shaped arm to engage the end fitting (52).

* * * * *